United States Patent [19]

Smith

[11] Patent Number: 4,977,626

[45] Date of Patent: Dec. 18, 1990

[54] GARMENT POCKET DISPENSER

[76] Inventor: Dawn M. Smith, 10213 - 34th St. West, Minnetonka, Minn. 55343

[21] Appl. No.: 296,971

[22] Filed: Jan. 17, 1989

[51] Int. Cl.[5] ..... A41D 27/20; B65D 69/00; A47K 10/24

[52] U.S. Cl. ..... 2/250; 2/251; 206/233; 206/812; 221/45; 221/199; 221/312 C

[58] Field of Search ..... 2/249, 250, 160, 247, 2/253, 247, 252, 254; 206/233, 812; 221/33, 45, 46, 47, 48, 63, 185, 199, 312 C, 303

[56] References Cited

U.S. PATENT DOCUMENTS

| | | | |
|---|---|---|---|
| 314,333 | 3/1885 | Heller | 2/196 X |
| 767,064 | 8/1904 | Kenyon | 2/93 |
| 905,796 | 12/1908 | Cummings | 2/247 |
| 1,089,203 | 3/1914 | Forman | 2/247 |
| 2,042,282 | 5/1936 | Tworoger | 2/247 |
| 2,072,030 | 2/1937 | Damron | 2/247 |
| 2,087,181 | 7/1937 | Conway | 312/62 |
| 2,123,447 | 7/1938 | Waite | 2/48 |
| 2,344,845 | 3/1944 | Baldeschwieler | 2/48 |
| 2,674,738 | 4/1954 | Mehlos | 2/48 |
| 3,295,717 | 1/1967 | Gantner | 221/46 |
| 3,325,003 | 6/1967 | Bilezerian | 221/46 X |
| 3,537,108 | 11/1970 | Daniels | 2/252 |
| 4,185,753 | 1/1980 | Leto | 221/45 |
| 4,401,233 | 8/1983 | Frey | 221/36 |
| 4,536,889 | 8/1985 | Taylor et al. | 206/233 X |
| 4,731,883 | 3/1988 | Foster | 2/69 |
| 4,739,809 | 4/1988 | Adams | 206/233 X |
| 4,805,242 | 2/1989 | Bolton | 2/160 |

OTHER PUBLICATIONS

Gershman, "Self-Adhering Nylon Tapes", *Journal of AMA,* vol. 168, No. 7.

*Primary Examiner*—Werner H. Schroeder
*Assistant Examiner*—Sara M. Current
*Attorney, Agent, or Firm*—Palmatier & Sjoquist

[57] ABSTRACT

A garment or the like including a dispenser pocket attached thereon, formed by two overlaid panels, one of which is partially detachable, forming a pocket therebetween and further having an elongate opening through the outer panel allowing the storage of a multiplicity of sheets to be stored within the pocket, and removable through the elongate opening.

15 Claims, 2 Drawing Sheets

GARMENT POCKET DISPENSER

BACKGROUND OF THE INVENTION

The present invention relates generally to dispensers for individually dispensing sheets, and more particularly to a dispenser adapted for inclusion into a garment or the like.

The idea of placing pockets in a garment for holding items is old and very well known in the arts. Such pockets typically are merely open-topped receptacles which require the user to reach into and manually segregate the items contained in the pocket. While this arrangement works well in most instances, it is often desirable to allow the user ready access to a plurality of individual sheets. Sheets of this type are often used for cleaning, food handling or wrapping and are readily available in packages of folded sheets, which may be interleaved. The folded sheets are usually disposable and may be packaged in a small, flat box for dispensing therefrom or may be packaged without a dispenser, suitable for insertion into a dispenser.

In either case, to use such disposable sheets, the user must separately carry the sheets to the working area which is often an inconvenience. While the user may place a plurality of the folded sheets in a conventional pocket or other receptable to avoid carrying the sheets separately, the single sheet dispensing feature of the interlocking sheets is lost.

When the sheets are carried in a separate dispenser, the user must move the dispenser to the work area and is thus burdened by carrying the dispenser and locating it for ease of use. Often the user expends much time and energy to first move the dispenser to his work area and second to access the sheets therefrom. Additionally, when the dispenser is a paper box or other lightweight unit, when the user attempts to remove a single sheet from the dispenser often the entire dispenser moves requiring the user to hold the dispenser while removing a single sheet. This occurrence defeats most of the advantages of a single sheet dispenser. While this disadvantage can be overcome by using a heavy or weighted dispenser, this would further burden the user with the requirement of moving the heavy dispenser to the work area.

Some attempts have been made to provide an easy-to-carry dispenser so that the user may have sheets readily accessible. Most of these are directed to a narrowly-defined apparatus and application such as cosmetology and cannot be used in a general purpose application. For example, U.S. Pat. No. 2,087,181, issued Nov. 18, 1935, discloses a dispenser for dispensing papers used when applying a permanent wave to hair. The dispenser includes a resilient clamp for attachment to a hair roller. While this device does move a dispenser into the work area, the dispenser still must be manually placed and moved. The dispenser also is not adaptable for use with general purpose sheets of larger sizes.

U.S. Pat. No. 4,185,753, issued Jan. 29, 1980, discloses a triangular dispenser attachable to a wrist bracelet for dispensing papers used in applying permanent wave to hair. While the wrist attachment does make the apparatus more portable, it must be carefully located on the wrist to be readily accessible without becoming burdensome or getting in the way. Again, this device is not readily adaptable for use with larger sized sheets and when sufficiently increased in size would become a substantial burden to carry about the workplace.

U.S. Pat. No. 4,401,223, issued Aug. 30, 1983, discloses another sheet dispenser attachable to the user's wrist for dispensing papers used in applying permanent wave to hair. The device again suffers the disadvantages inherent to wrist attachment of limiting the placement of the hand it is attached to, requiring the movement of both hands to dispense a paper, and not being adaptable for use with larger sheets.

SUMMARY OF THE INVENTION

The invention comprises a garment or the like having an overlay attached thereon at a suitable location. The overlay is preferably attached along a first edge and detachably retained along three remaining edges to allow ready access to the interior of the compartment formed by the cooperation of the garment and the overlay. A multiplicity of folded sheets, preferably interleaved, are placed in the compartment with a first sheet extending outwardly from an opening therein.

It is a principle object of the invention to provide an improved garment adapted to store and dispense single sheets therefrom.

Another object of the invention is to provide the functions of carrying a sufficient quantity of sheets in a convenient dispensing pocket without encumbering the user with external attachments that limit the user's mobility and dexterity.

Another object of the invention is to provide a portable sheet dispenser which is fitted into a garment and does not make the garment bulky.

Another object of the invention is to provide a garment with a dispenser which allows the easy access to a single sheet while using a single hand.

Another object of the invention is to provide a sheet dispenser adaptable for use on existing garments.

A further objective of the invention is to provide a dispenser adaptable for using sheets of varying sizes and compositions.

BRIEF DESCRIPTION OF THE DRAWINGS

The foregoing and other objects of the invention will become apparent upon a reading of the following specifications, with reference to the appended claims and drawings, in which:

DESCRIPTION OF THE PREFERRED EMBODIMENT

Figure 1:
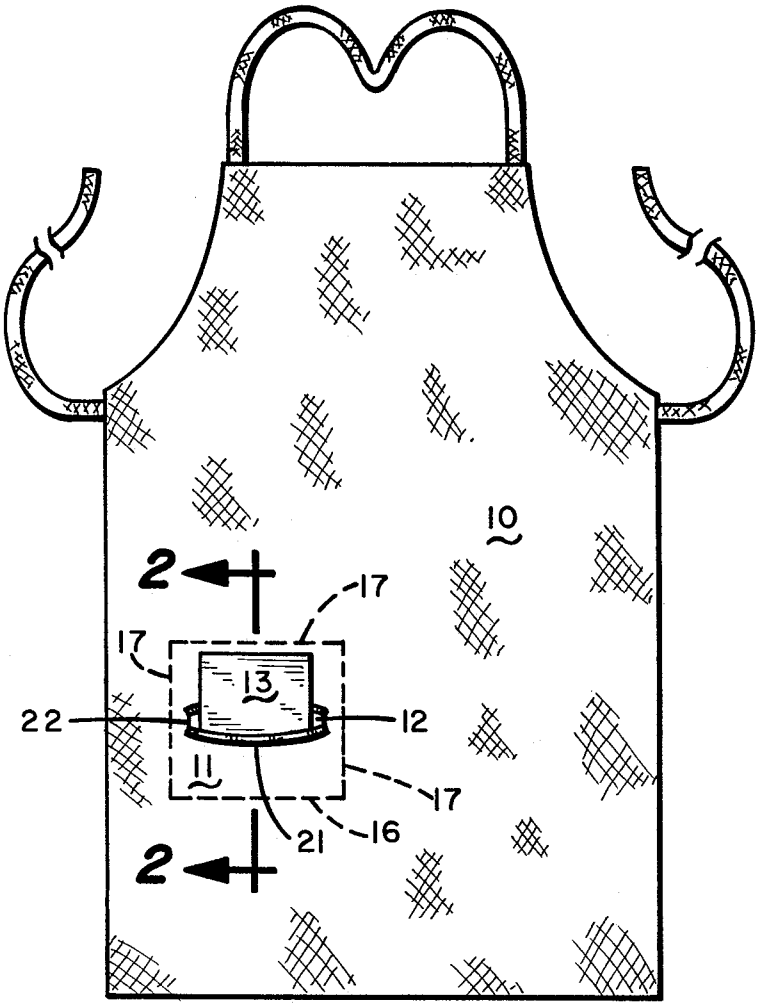
FIG. 1 is a front view showing the first embodiment of the dispenser pocket attached to an apron.
Figure 2:
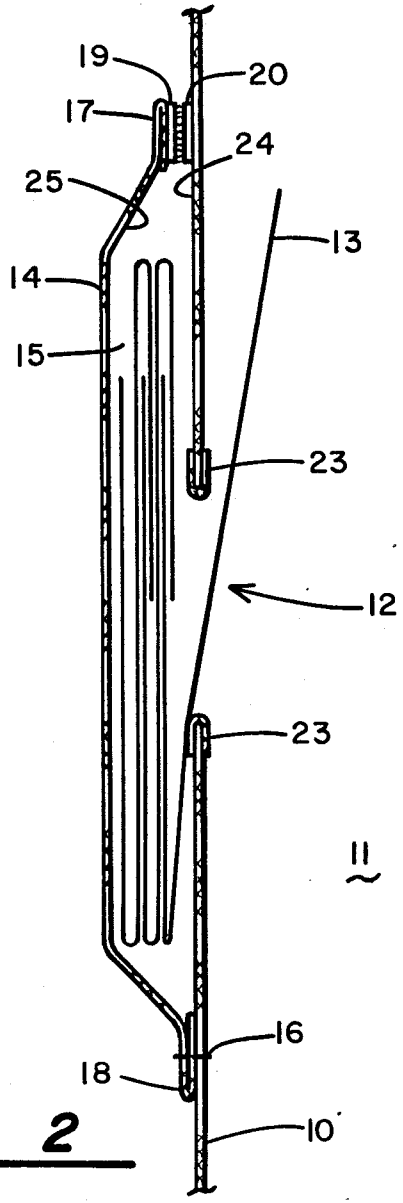
FIG. 2 is a cross-sectional view of the dispenser pocket taken along line 2—2 of FIG. 1.

Referring first to FIGS. 1 and 2, there is shown the first embodiment of a substantially vertically oriented dispenser pocket. A garment, generally 10, has a dispenser 11 located thereon. The dispenser 11 has an elongate opening 12 thereon for dispensing individual sheets 13 therefrom. The pocket overlay 14 is located on the interior side of the garment 10 about the elongate opening 12 and cooperates with the garment 10 to form a compartment 15 for storage of multiple sheets 13 therebetween.

While the garment 10 dsis shown as a protective apron, it is understood that the dispenser 11 may be used with any other suitable garment for dispensing single sheets 13, and the garment and dispenser may be made from fabric or any other appropriate material.

The dispenser 11 is an area of the garment 10 defined by the compartment 15 and the cooperation of the garment 10 with the pocket overlay 14. The pocket overlay 14 may be attached in a number of ways and is preferably fixedly attached along a first edge 16 and detachably retained along the remaining three edges 17. The first edge 16 of the pocket overlay 14 may be attached to the garment 10 in many ways and is preferably attached by folding the pocket overlay first edge 16 into a fold 18 and stitching through the multiple layers to attach the pocket overlay 14 to the garment 10. The stitched seam at the first edge 16 of the pocket overlay 14 serves to add strength to a stress area and also serves to hide the exposed edge of the pocket overlay 14 to reduce unsightly fraying thereof.

The remaining three edges 17 of pocket overlay 14 are likewise finished in a fold to add strength and reduce unsightly fraying. The remaining three edges 17 of the pocket overlay 14 may be retained adjacent to garment 10 using any number of retainer means, such as, buttons, hooks, or zippers, although they are preferably retained using mating pads 19, 20 of hook and loop retainers that adhere when pressed together. The mating retaining pads 19, 20 are available from a number of commercial sources and are common sold under the trademark Velcro ®.

The substantially vertically oriented dispenser 11 is shown having the elongate opening 12 disposed in a substantially horizontal position. It is understood, however, that in certain other applications it is advantageous to place the elongate opening 12 diagonally or even vertically.

The elongate opening 12 may be of any suitable shape and it is preferred that the elongate opening be a truncated ellipse having longer curved sides 21 and shorter straight sides 22, allowing the sheets 13 to be dispensed therethrough. The dispensing of the sheets 13 is further controlled and enhanced by the inclusion of a sewn edging 23 disposed extending from the curved side 21 outwardly into the elongate opening 12. The edging 23 may be formed of any suitable material and is typically constructed of a double thickness of cloth and is attached to the curved side 21 of the elongate opening. The edging 23 is flexible so as to assist retaining the sheets 13 and guide the removal of an individual sheet 13.

A garment liner 24 may be optionally attached to the interior of the garment 10 or a pocket liner 25 may optionally be attached to the interior of the pocket overlay 14. The liners 24, 25 are used to protect the garment 10 and pocket overlay 14 from damage and abrasion from the sheets 13. Additionally, the liners 24, 25 may be constructed of a dimensionally stable material to prevent unsightly distortion of the garment 10 in the area of the dispenser 11.

While two liners 24, 25 are disclosed, it is understood that in the various applications of the invention it may be advantageous to not use liners 24, 25 or to use either a garment liner 24 or a pocket overlay liner 25.

Figure 3:
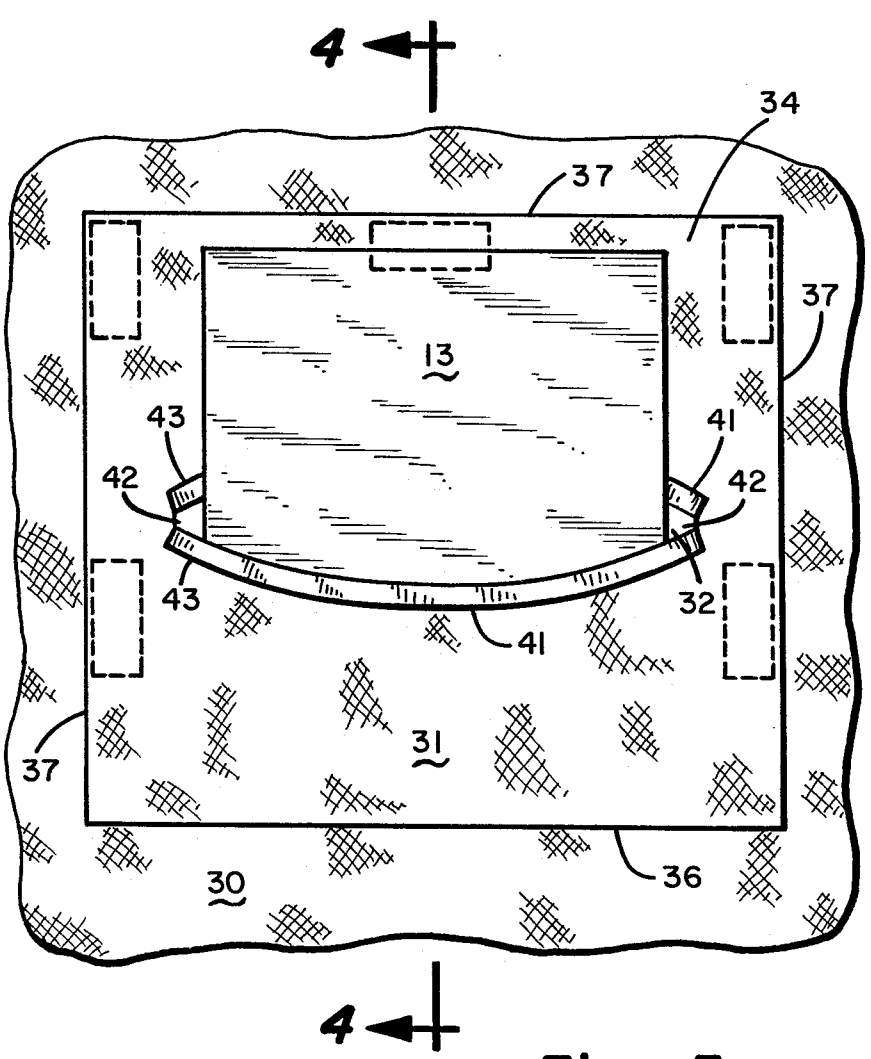
FIG. 3 is a front view of a second embodiment of the invention.
Figure 4:
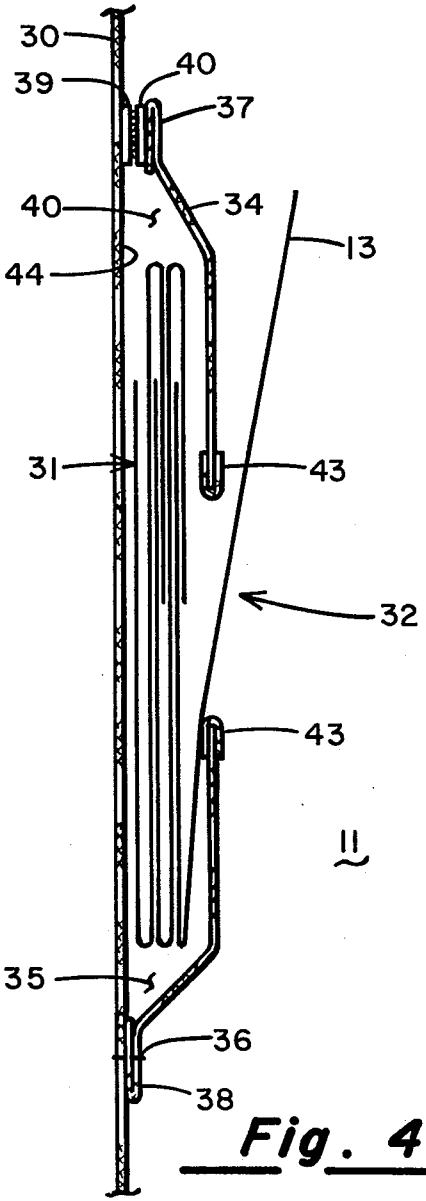
FIG. 4 is a cross-sectional dispenser pocket taken along the line 4—4 of FIG. 3.

In second embodiment of the invention, as shown more clearly in FIGS. 3 and 4, the garment 30 has a dispenser 31 located conveniently thereon for dispensing single sheets 13 through an elongate opening 32 in the dispenser 31. The pocket overlay 34 in this embodiment is disposed on the exterior of the garment 30 and has an elongate opening 32 extending therethrough and cooperates with the garment 30 to define a compartment 35 therebetween. The pocket overlay 34 has a first edge 36 affixed to the garment 30. The first edge may be affixed using any suitable means and is preferably attached by triple folding the first edge 36 into a fold 38 and stitching the first edge 36 to the garment 30. The three remaining edges 37 are preferably detachably attached to the garment 30, preferably using mating hook and loop retainer pads 39, 40 which are readily available under the trademark Velcro ®.

Elongate opening 32 is preferably shaped as a truncated ellipse having curved sides 41 and shorter straight sides 42. A stitched edging 43 may be disposed along the curved sides 41 of the elongate opening 32.

A liner 44 may be attached adjacent the exterior surface of the garment 30 within the dispenser 31. The liner 44 serves to protect the garment 30 and to enhance the dimensional stability of the garment 30 in the area of the dispenser 31 so that the dispenser area 31 does not distort or sag.

The second embodiment of the dispenser 31, as shown in FIGS. 3 and 4, resides totally on the exterior of the garment 30 and as such is particularly adaptable for addition to existing garments. Thusly, the dispenser 31 may be attached to an existing garment 30 by sewing along the first edge 36 of the pocket overlay 34 to an appropriate place upon the garment 30. The retainer pads 39 are then sewn to the exterior of the garment 30 and located so as the retainer pads 39 will abut with the mating retainer pads 40 to retain the remaining edges 37 of the pocket overlay 34. Of course, in either of the embodiments described herein it may be useful to stitch the lower edge and one or both vertical side edges to the garment, leaving only the top edge secured by detachable fasteners.

In its use, a garment-containing dispenser can be filled with a multiplicity of interleaved sheets by separating the respective retaining pads and thereby accessing the interior compartment of the dispenser. A suitable number of the sheets are then placed within the compartment with a first sheet extending outward through the elongate opening. The compartment is then closed by mating the retaining pads and the garment is then ready to use with the dispenser.

The user will use the dispenser by removing the sheets individually from the dispenser for whatever use the task at hand requires. As the first sheet is withdrawn from the dispenser, the interleaved nature of the sheets causes a second sheet to extend outwardly through the elongate opening where it is ready for removal when the user so desires.

The invention is readily adaptable for many uses, principally in two areas. In the first, the sheets 13 may be used for sanitary or health reasons; in the second area, the sheets 13 may be used for cleaning purposes.

In the first area of use, the dispenser may be sized to accept wax paper sheets, or other type sheets, such as are used in a bakery or delicatessen for selecting individual items for sale to customers. Typically health regulations require that paper or gloves be used so that the clerk does not touch the foodstuff being sold. In this use, the user has a supply of sheets readily available while selecting the items the customer has purchased.

In the second area of use, the sheets may be disposable sheets for cleaning and wiping, usable for cleaning either the user's hands or work area. It is particularly useful to have cleaning sheets available to workers, such as mechanics, who work in a dirty environment and must repetitively clean items to continue their work. In this environment, the user has a supply of cleaning sheets at his disposal and need not search for cleaning sheets when they are needed. Therefore, increasing the efficiency and convenience of the worker.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A garment or the like for use in an environment comprising a substantially vertically oriented dispenser area located integral to said garment, the dispenser cooperating with said garment to form an inner panel and an outer panel, the dispenser disposed on the surface of the garment, said inner panel and outer panel being attached along a common peripheral first edge, said inner panel and outer panel further having detachable retaining means cooperatively disposed along one or more of the respective remaining peripheral edges thereof, retaining said edges proximate thereto and forming a compartment therebetween; said outer panel further having a central, horizontal, elongate and elliptical opening located therein with said opening having opposing ends truncated in straight edges; whereby, a multiplicity of folded sheets may be placed in the compartment by separating the retaining means and placing the multiplicity of sheets into the compartment while extending a first sheet through the elongate opening of the outer panel allowing ready access to the first sheet.

2. The invention as defined in claim 1, wherein the garment forms the inner panel.

3. The invention as defined in claim 1, wherein the garment forms the outer panel.

4. The invention as defined in claim 1, wherein the retaining means further comprises mating hook and loop retainer strips having the hook strips disposed on the one panel and the loop strips disposed on the other panel.

5. The invention as defined in claim 1, wherein the elliptical opening further has an edging material extending from the curved edges of the elliptical opening thereinto.

6. A garment or the like having a dispenser pocket located thereon, the dispenser pocket comprising a central, horizontal, elongate and elliptical opening on and extending through said garment; a pocket overlay located on the inner surface of said garment and disposed about the elongate opening, the pocket overlay attached to said garment along a first peripheral edge, and said garment and pocket overlay further having detachable retaining means disposed along the remaining edges of said pocket overlay cooperating with mating retaining means attached to said garment, retaining the pocket overlay proximate to said garment, and forming an openable compartment between said garment and said pocket overlay with the elongate opening extending into the compartment; whereby, a multiplicity of folded sheets maybe placed in the compartment by separating the retaining means and placing the multiplicity of sheets into the compartment while extending a first sheet through the elongate opening of the outer panel allowing ready access to the first sheet.

7. The invention as defined in claim 6, wherein the retaining means further comprises mating hook and loop retainer strips having the hook strips disposed on the one panel and the loop strips disposed on the other panel.

8. The invention as defined in claim 6, wherein the elliptical opening further has opposing ends truncated in straight edges.

9. The invention as defined in claim 8, wherein the elliptical opening further has an edging material extending from the curved edges of the elliptical opening thereinto.

10. A garment or the like having a substantially vertically oriented dispenser pocket located thereon, the dispenser pocket comprising a pocket overlay attached to the garment along at least a first peripheral edge thereof and removably attached along the remaining edges by retaining means adjacent the outer surface of the garment forming an openable compartment between the garment and the pocket overlay; a central, horizontal, elongate and elliptical opening disposed on and extending through said pocket overlay to the compartment with said opening having opposing ends truncated in straight edges; whereby, a multiplicity of folded sheets may be placed in the compartment by separating the pocket overlay from the garment and placing the multiplicity of sheets into the compartment while extending a first sheet through the elongate opening of the outer panel, returning the pocket overlay proximate to the garment allowing ready access to the first sheet.

11. The invention as defined in claim 10, wherein the retaining means further comprises mating hook and loop retainer strips having the hook strips disposed on the one panel and the loop strips disposed on the other panel.

12. The invention as defined in claim 10, wherein the elliptical opening further has an edging material extending from the curved edges of the elliptical opening thereinto.

13. A substantially vertically oriented garment pocket dispenser attachable to the outer surface of a garment or the like, comprising (a) a pocket overlay attachable to the outer surface of the garment along the peripheral edges of the overlay with at least one of the edges being removably attachable forming an openable compartment between the garment and the pocket overlay; and (b) a central, horizontal, elongate and elliptical opening disposed on and extending through the pocket overlay to the compartment with said opening having opposed ends truncated in straight edges; whereby, a multiplicity of folded sheets may be placed in the compartment by separating the removably attachable edge from the garment and placing the multiplicity of sheets into the compartment while extending a fist sheet through the elongate opening of the pocket overlay and attaching the removably attachable edge to the garment allowing ready access to the first sheet.

14. The invention as defined in claim 13, wherein the removably attachable edge further comprises mating hook and loop retaining strips having the hook strips disposed on either of the panel overlay or the garment and the loop strips disposed on the other of either the panel overlay or the garment.

15. The invention as defined in claim 13, wherein the elliptical opening further has an edging material extending from the curved edges of the elliptical opening thereinto.

* * * * *

UNITED STATES PATENT AND TRADEMARK OFFICE

CERTIFICATE OF CORRECTION

PATENT NO. : 4,977,626

DATED : December 18, 1990

INVENTOR(S) : Dawn M. Smith

It is certified that error appears in the above-identified patent and that said Letters Patent is hereby corrected as shown below:

Column 3, line 1, delete "dsis" and replace it with --is-- .

Signed and Sealed this

Twelfth Day of May, 1992

*Attest:*

DOUGLAS B. COMER

*Attesting Officer*

*Acting Commissioner of Patents and Trademarks*